US007107982B1

(12) United States Patent
Lechner

(10) Patent No.: US 7,107,982 B1
(45) Date of Patent: Sep. 19, 2006

(54) APPARATUS AND METHOD FOR CUTTING BRICKS

(76) Inventor: Donald W. Lechner, 19123-A Horseshoe Cir., Seminole, AL (US) 36574

( * ) Notice: Subject to any disclaimer, the term of this patent is extended or adjusted under 35 U.S.C. 154(b) by 0 days.

(21) Appl. No.: 11/132,255

(22) Filed: May 19, 2005

(51) Int. Cl.
*B28D 1/32* (2006.01)

(52) U.S. Cl. ..... 125/23.01; 125/35

(58) Field of Classification Search ..... 125/23.01, 125/23.02, 30.01, 35; 225/103–105
See application file for complete search history.

(56) References Cited

U.S. PATENT DOCUMENTS 600,856 A * 3/1898 Brinkman ..... 125/23.01
3,161,190 A * 12/1964 Stephens et al. ..... 125/23.01

FOREIGN PATENT DOCUMENTS

EP 0 522 749 A1 1/1993
FR 2 554 025 A1 4/1985

OTHER PUBLICATIONS

Brick Cutter, GardenWeb.com http://forums2.gardenweb.com/forums/load/tools/msg031542315377.html, 1 page, printed from the Internet on Mar. 25, 2005.

"Brick Splitter," KraftTool.com http://www.krafttool.com/masonry4.htm, 1 page, printed from the Internet on Mar. 25, 2005.

"Bon Tool Brick Buster,", NorthernTool.com http://www.northerntool.com/webapp/wcs/stores/servlet/ProductDisplay?storeId=6970&productID=200253624&R=200253624&storeID=6970&langID=%2D1&cm_ven=Paid%2520Inclusion&cm_pla=Froogle&cm_ite=Froggle, 1 page, printed from the Internet on Mar. 25, 2005.

* cited by examiner

*Primary Examiner*—Dung Van Nguyen
(74) *Attorney, Agent, or Firm*—Richard C. Litman

(57) ABSTRACT

The apparatus for cutting brick is an apparatus for cutting masonry material. The apparatus includes an assembly base, a lever operating assembly, an upper blade assembly, a lower blade assembly, and a table assembly. The lever operating assembly supports a system of levers allow an operator to apply a force which is ultimately applied to a pair of cutting chisels which cut the piece of masonry material. The apparatus may be comprised of two levers providing a force multiplier system. The upper chisel is moved by the lever operating system to separate the upper and lower chisel allowing material to be placed in the cutting apparatus, and to force the upper chisel towards the lower chisel to cut the material. The table assembly rests on resilient mounts. The table covers the lower chisel, but is lowered to expose the cutting edge of the chisel during a cutting operation.

7 Claims, 6 Drawing Sheets

APPARATUS AND METHOD FOR CUTTING BRICKS

BACKGROUND OF THE INVENTION

1. Field of the Invention

The present invention relates to the shaping of masonry materials, and in particular to a manually operated apparatus and process for cutting bricks, tile or the like.

2. Description of the Related Art

The use of relatively brittle materials, such as brick and tile, as decorative building materials is well known in the art. These materials are known as masonry materials. Masonry materials are generally supplied to the work site in standard shapes and sizes. During construction using these materials, it is a requirement that these building materials be cut into the shapes required to fit in a particular position in a project. Quite often there is a need to accurately cut large numbers of bricks to the same particular shape. In other cases tiles or bricks of a number of different shapes may be needed. A great deal of time may be consumed shaping materials on a construction site.

Often the exact shape needed is determined on the job site by masons or other construction workers of various skill levels. When materials are cut improperly, the need to repeat the shaping operation results in the waste of time and materials and increases the cost for completing a construction project.

The design of the apparatus used to cut bricks, tiles, and other brittle construction materials can contribute to efficiency on the construction site in a number of ways. Hydraulic press cutters, saws and mechanical cutters have been used to cut bricks, tile and other brittle materials to the desired shapes. Some of these devices are relatively expensive. Cost considerations can limit the number of cutting devices used on a work site, thus introducing inefficiencies in completing work. Logistical considerations involved with the supply of electrical power on a construction site can limit the placement and number of electrically powered cutting devices that can be made available on a job site. When the cutting devices are limited in number or placed inconveniently far from where shaped materials are being used, the resulting inefficiency of workflow may increase the time and cost required for a construction project.

Another consideration is the portability and compactness of the cutting device. If a cutting device is easily moved from one place to another and does not require large amounts of space when in use, the device can be located convenient to the place where masonry materials are used, resulting in increased efficiency and reduced time and cost to complete a project.

It would therefore be desirable to provide a cutting apparatus for cutting bricks, tiles, and other brittle construction materials which is compact, portable and manually operated. It is desirable that the apparatus be capable of making repeated cuts of materials to a given shape or dimension and that the apparatus be quickly adjustable to deliver different shapes or to accommodate the size and shape of bricks, tiles or other materials. It is also desirable that the apparatus be simple to operate.

French Patent 2,553,025, published on Apr. 12, 1985, describes a tile and brick cutting apparatus with a movable and a fixed cutting blade. The apparatus is distinguishable by the means provided for moving the upper blade.

Thus, a brick cutter solving the aforementioned problems is desired.

SUMMARY OF THE INVENTION

The apparatus for cutting bricks, also referred to herein as a brick cutter, is an apparatus for cutting masonry material. The brick cutter includes an assembly base, a lever operating assembly, an upper blade assembly, a lower blade assembly, and a table assembly. The lever operating assembly supports a system of levers that allows an operator to apply a force that is ultimately applied to a pair of cutting chisels, which cut the piece of masonry material. The apparatus may be comprised of two levers providing a force multiplier system. The upper chisel is moved by the lever operating system to separate the upper and lower chisel, allowing material to be placed in the cutting apparatus, and to force the upper chisel towards the lower chisel to cut the material. The table assembly rests on resilient mounts. The table covers the lower chisel, but is lowered to expose the cutting edge of the lower chisel through a slot in the table during a cutting operation. The table is lowered when the upper chisel presses down on the material to be cut, compressing the resilient mounts. The resilient mounts may be springs or may be standoffs made of an elastic, compressible material such as rubber or neoprene.

The chisels may have a sharpened edge made of tungsten carbide.

The cutting apparatus may include a spring for automatically returning the cutting chisels to the starting position after a cutting operation. The spring may be attached between a stationary part of the apparatus such as the assembly base and a moving portion of the lever operating assembly and is arranged to store energy through compression or tensioning of the spring during a cutting operation and using the stored energy to return the levers and the cutting chisels to the starting position after the masonry material has been cut.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an apparatus for cutting bricks and for trimming masonry materials. Masonry materials are bricks; tiles such as ceramic tiles; and similar brittle construction materials.

Figure 1:
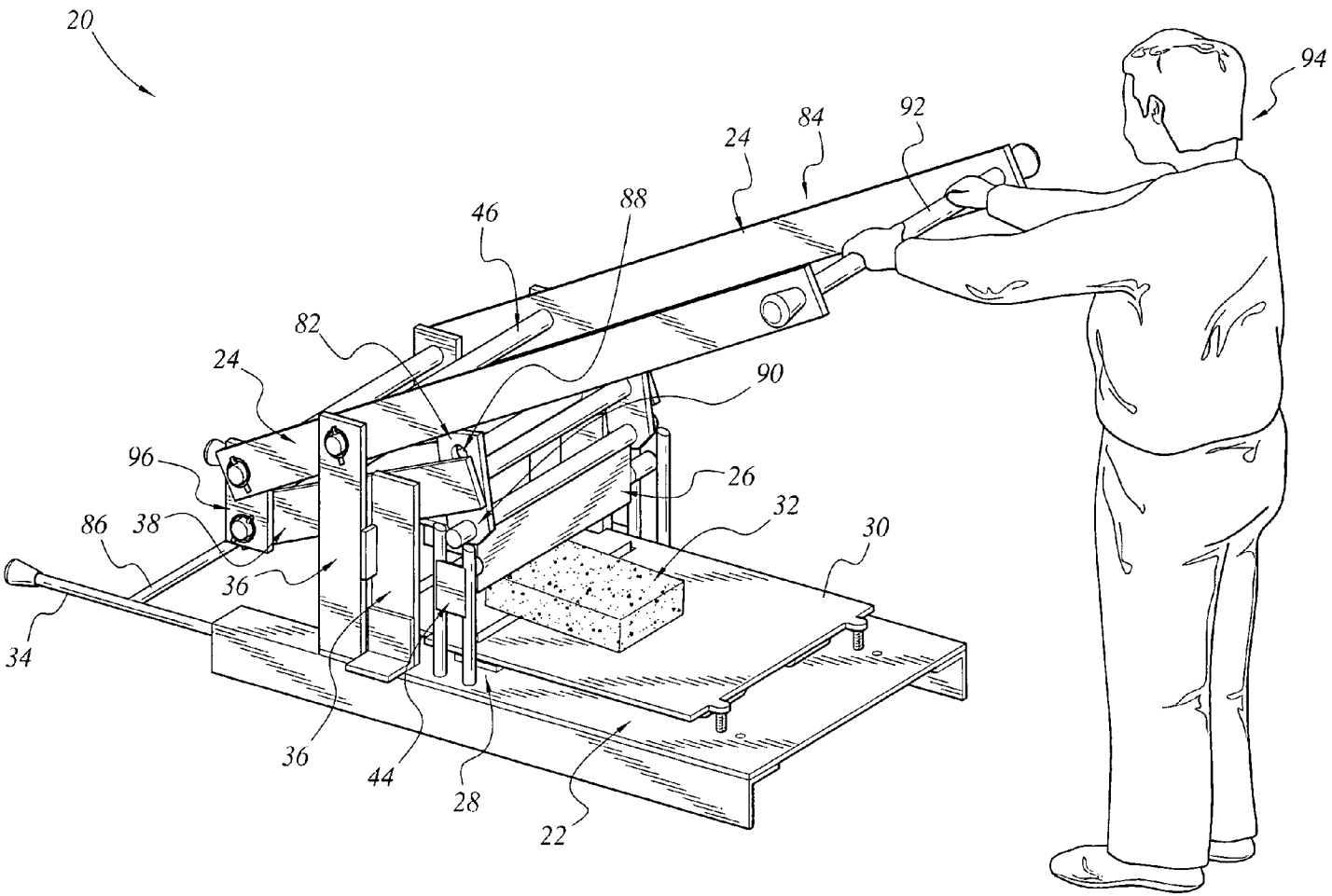
FIG. 1 is an environmental, perspective view of a brick cutter according to the present invention.
Figure 2:
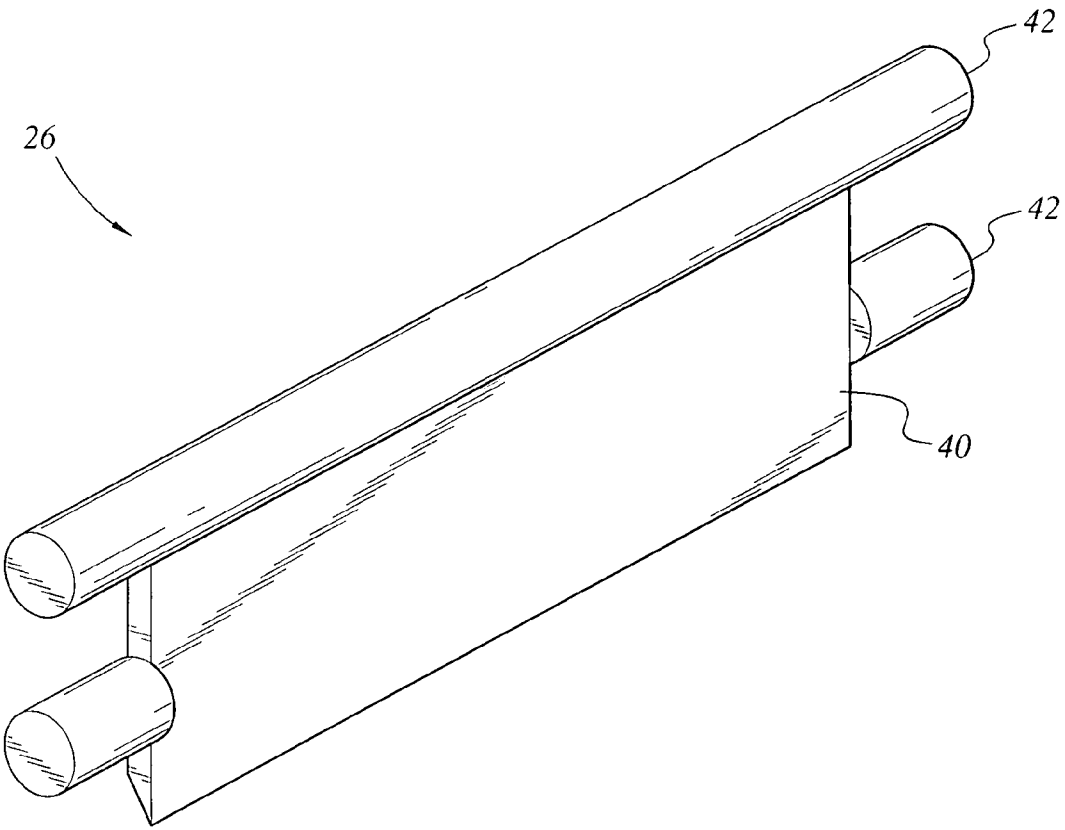
FIG. 2 is a perspective view of the upper blade assembly of a brick cutter according to the present invention.

FIG. 1 shows a perspective view of a masonry or brick cutting apparatus 20 in accordance with an embodiment of the invention set up to cut a brick 32. The apparatus comprises an assembly base 22 to which is attached an upper blade support assembly 44, a lever operating assembly 84, and a lower table assembly 30. The base 22 additionally supports a lower blade assembly 28. The apparatus further comprises an upper blade assembly 26. The upper blade support assembly includes a vertical track 24 that positions an upper chisel 40, as shown in FIG. 2, and guides the motion of the upper chisel 40 during a cutting operation.

The assembly base 22 comprises a flat rectangular horizontal surface. The assembly base 22 provides overall support to the apparatus 20. The base 22 is constructed of a suitably rigid material. The dimensions of the base 22 are chosen to be large enough to provide a stable platform during use and to provide an adequate working area so that the brick or tile to be cut can be position at various angles to produce the desired cut.

In an embodiment of the invention, the assembly base 22 is constructed of steel and is approximately twelve inches wide and approximately twenty-four inches long.

The lever support assembly 36 is attached to the assembly base 22 near the rear edge of the base 22. The lever support assembly 36 comprises one or more pairs of vertical lever support members 36 attached to the assembly base at each side of the assembly base 22 near the rear edge. Members of each pair of vertical support members are attached on opposite sides of the assembly base at the same distance from the rear edge.

The lever operating assembly 84 is attached to the lever support assembly. The lever operating assembly comprises one or more levers (24 and 38). When a plurality of levers are provided, a first lever 24 forms the manual operator by which a user applies a downward force to operate the cutting apparatus, while a final lever 38 transfers the force from the manual operator to the upper chisel 26. When a single lever is provided, the single lever is both the manual operator and the final lever providing the means for transferring force to the upper chisel. The lever, or the plurality of levers, comprises two parallel members 24 pivotally attached to opposing members of the lever support assembly 36. The parallel lever members are joined by a plurality of cross members 46 that maintain the separation distance between the lever members 24 and allow the parallel members 24 to operate as a single lever. The lever operating assembly comprises two levers 24 and 38 pivotally connected at their rearmost ends by a linking member 96. Each lever member is pivotally attached to a lever support member 36. By using two levers the mechanical advantage of the levers can be combined to generate the overall mechanical advantage for the apparatus. The combined mechanical advantage develops the required cutting force to the upper chisel 26 without the use of an inordinately long operating handle. Reducing the length of the operating handle allows the overall device to be relatively compact. The use of levers comprising dual lever members facilitates the even application of force to the upper chisel 26. In another embodiment, the lever comprises a single member rather than a plurality of members.

The length of the levers is chosen to provide sufficient mechanical advantage so that an operator can readily supply the force needed to cleanly cut bricks and tiles. Two levers are provided with the first lever 24 having a working length of about twenty-four inches and the second lever 38 having a working length of about eleven inches. The lever operating assembly provides an overall mechanical advantage of approximately eight.

The upper blade support assembly 44 comprises two track assemblies attached to opposite sides of the base. The track assemblies are attached towards the rear edge of the base and forward of the vertical members of the lever support assembly.

Each track assembly comprises two vertical cylindrical steel members separated to form a vertical gap or vertical track between the members. A supporting member may be welded between the outside surfaces of the track assembly members to provide mechanical support and stability to the track assembly. The track assemblies may be attached to the sides of the assembly base by welding.

Figure 3:
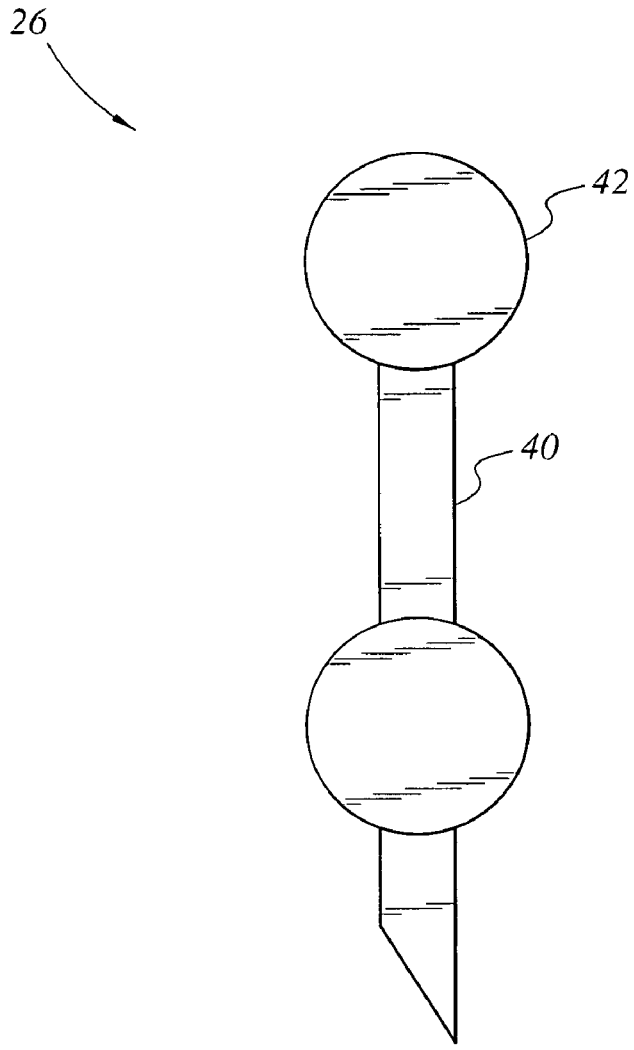
FIG. 3 is a side view of the upper blade assembly shown in FIG. 2.

FIGS. 2 and 3 show the upper blade assembly 26. The upper blade assembly 26 comprises an upper chisel 40 and a track rider 42. The lower portion of the upper chisel 40 is a sharpened edge of a material of suitable hardness for cutting tiles, bricks, cinderblocks and other materials. The chisel edge 40 may be made of a tungsten carbide alloy.

The track rider comprises a plurality of parallel cylindrical rider elements 42. The rider elements 42 are cylinders or cylinder segments attached to the top or sides of the upper chisel. The ends of the track rider elements 42 slidably engage the track formed by the upper blade support assembly 44. The diameter of the track rider elements 42 is consistent with the width of the track so that the track accurately maintains the horizontal position and vertical orientation of the upper chisel 40 during a cutting operation without developing an undue amount of friction between the track and the track rider 42 elements 42. The track constrains the upper chisel 26 to follow a vertical path during operation of the manual operator.

The width of the upper chisel 26 is chosen so that it extends over most of the width of the base, providing a long cutting length. Maximizing the cutting length allows the apparatus 20 to cut large masonry products and eliminates the need for precise lateral positioning when cutting smaller tiles and blocks. The upper chisel 40 may be approximately eight inches wide and the rider elements may be approximately eleven inches wide, and the separation between the track rider elements may be approximately two inches.

Figure 4:
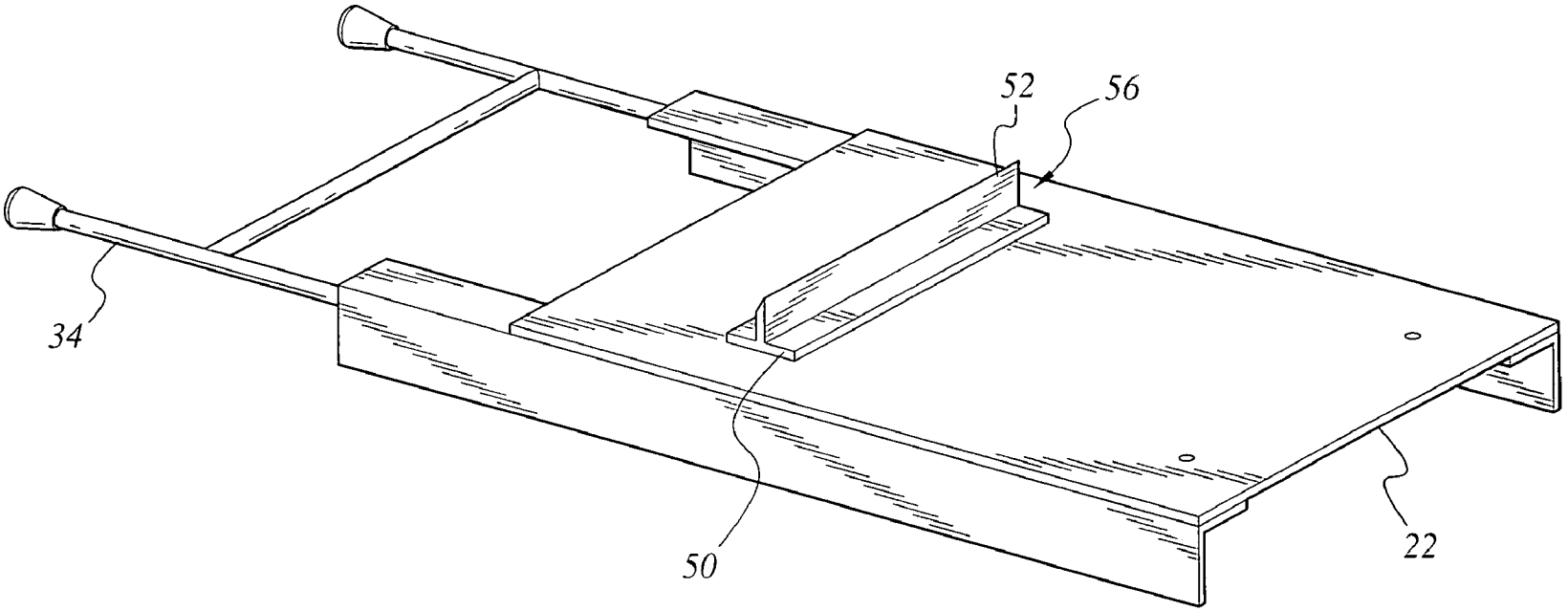
FIG. 4 is a perspective view of the lower blade assembly and the base assembly of a brick cutter according to the present invention.
Figure 6:
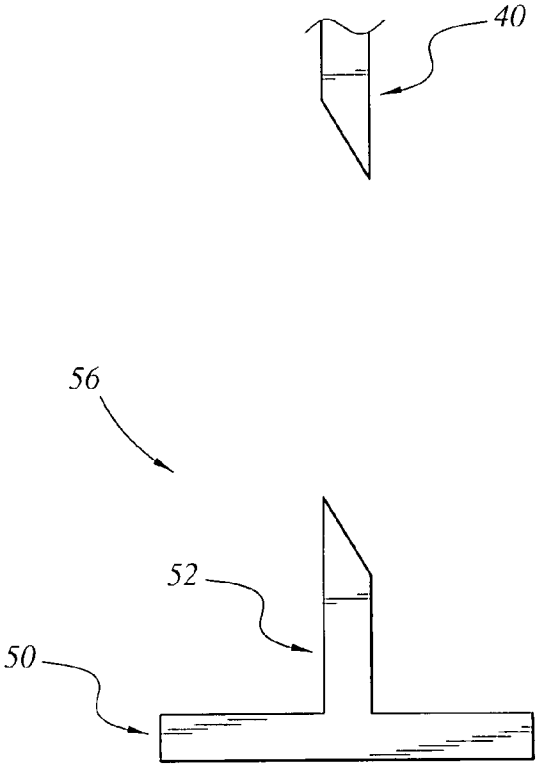
FIG. 6 is a side view of the lower blade assembly showing an alternate position of the lower chisel.
Figure 5:
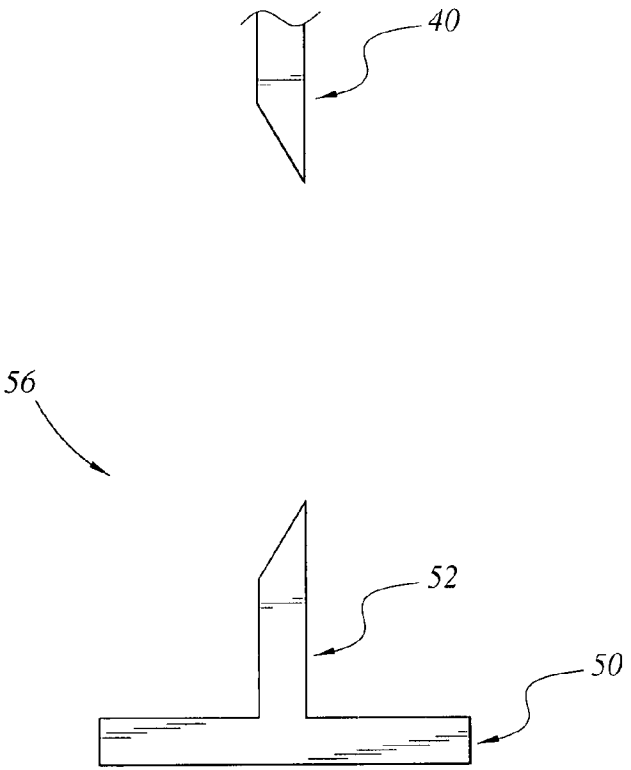
FIG. 5 is a side view of the lower blade assembly shown in FIG. 4.

FIGS. 4–6 illustrate the lower blade assembly 56. The lower blade assembly 56 is supported vertically by the assembly base 22. The lower blade assembly 56 comprises a lower blade base 50 and a vertically oriented lower chisel 52. The lower blade base 50 rests on the assembly base 22, but is not attached to the assembly base 22, allowing the orientation of the lower blade assembly 56 to be reversed. The upper portion of the lower chisel 52 is a sharpened edge of a material of suitable hardness for cutting tiles, bricks, cinderblocks and other materials. The lower chisel edge may be made of a tungsten carbide alloy. The lower chisel 52 is attached to the lower chisel-supporting base 50, preferably by welding. The width of the chisel supporting base 50 is chosen to provide adequate vertical stability for the lower chisel during operation. The lower blade-supporting base 50 may be two inches wide. The lower chisel 52 is attached to the lower blade-supporting base 50, preferably by welding, so that the plane of the chisel 52 is perpendicular to the plane of the supporting base 50. The horizontal cross section of the lower chisel 52 is substantially the same as that of the upper chisel 40.

FIGS. 5 and 6 illustrate the shapes of the cutting edges of the upper 40 and lower chisels 56 in a preferred embodiment of the invention. The lower edge of the upper chisel 40 has a single taper forming a sharp cutting edge at the lower front surface of the upper chisel 40. The upper edge of the lower chisel 52 has a corresponding taper forming a sharp cutting edge similar to that of the upper chisel.

As shown in FIG. 5, the lower chisel may be positioned so that the cutting edge of the lower chisel 52 is directly below the cutting edge of the upper chisel 40. The lower cutting chisel 52 may also be reversed, as shown in FIG. 6, so that the edge of the lower chisel 52 is parallel to the upper chisel 40, but is offset by the thickness of the lower chisel 52. The thickness of the lower chisel 52 is about ⅜ of an inch, resulting in an offset between the upper and lower cutting edges of ⅜ of an inch when the lower chisel 52 is reversed. The offset configuration allows cutting bricks so that the upper surface and the lower surface have different lengths. Bricks with this shape are commonly used in a number of construction applications.

Figure 7:
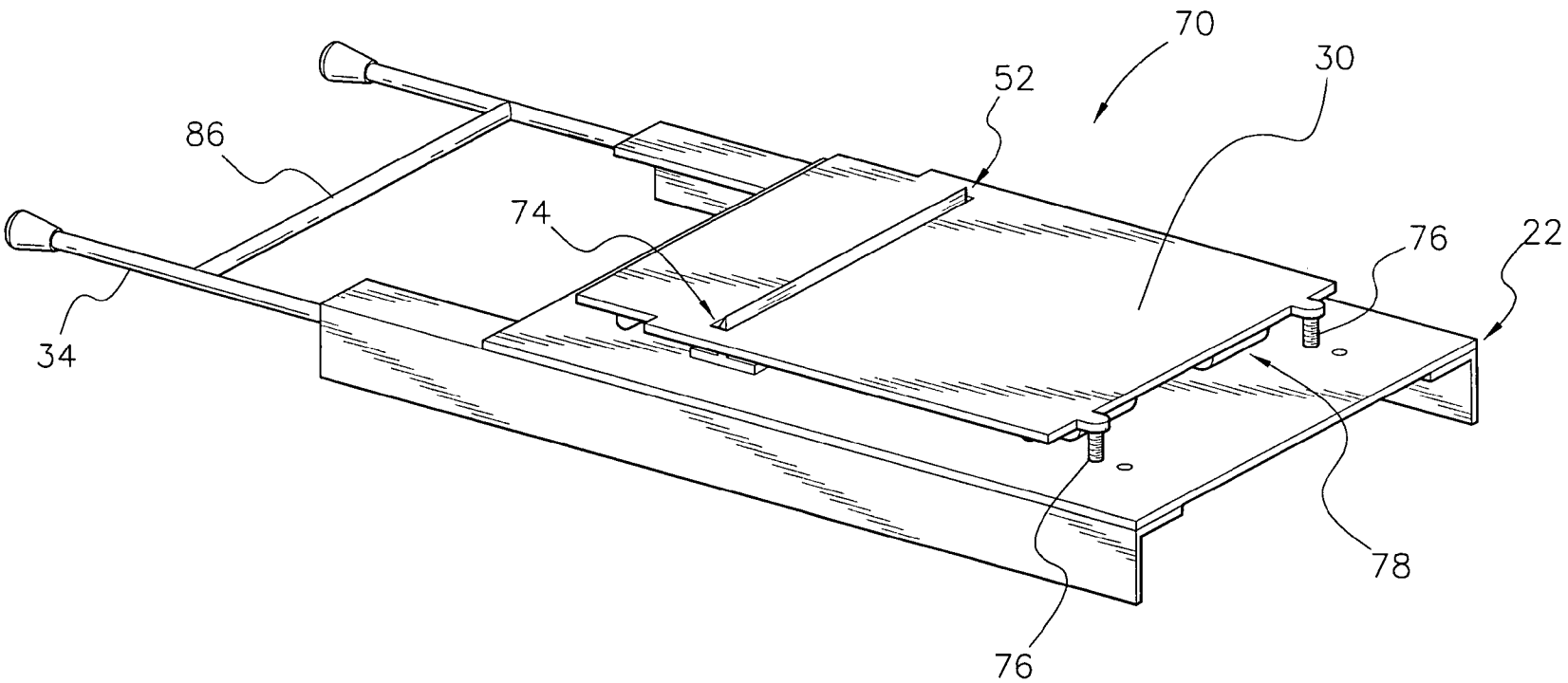
FIG. 7 is a perspective view of the lower table assembly of a brick cutter according to the present invention.

FIG. 7 shows the details of the table assembly 70. The table assembly 70 may comprise a brick table 30, a table guide 76, and table supports 78. The brick table 30 provides a horizontal surface supporting the brick, tile or other material being cut 32 when using the invention. A slot 74 is provided near the rear end of the brick table 30. The slot 74 is sized to slidably engage the lower chisel 52, so that in use the table maintains the horizontal position of the lower chisel 52. The slot is positioned directly underneath and parallel to the upper chisel 40. A plurality of table supports 78 are attached to the lower surface of the brick support table 30. The table supports 78 are resilient mounts which provide a compressible support for the brick support table 30. The resilient mounts may comprise springs, or may be standoffs of a compressible, elastic material, such as rubber, neoprene or the like. The resilient mounts 78 are provided at both the rear and front edge of the brick table 30 so that the table 30 is maintained parallel to the assembly base 22 during cutting operations. The resilient mounts 78 maintain the table at a height above the table 30 so that the cutting edge of the lower chisel 52 is not exposed through the slot 74 while the material to be cut is being positioned prior to a cutting operation. During a cutting operation, force applied is applied to the upper chisel 40 and transmitted to the brick or tile 32, compressing the resilient mounts 78, thereby lowering the table 30 so that the edge of the lower chisel 52 contacts the brick or tile to be cut.

In an alternate embodiment, the table supports 78 comprise a plurality of resilient mounts attached to the assembly base 22 rather than to the movable table 30, and the table is supported vertically by the resilient mounts.

The table guide 76 maintains the horizontal position of the horizontal table 30; the table 30, in turn, maintains the horizontal position of the lower blade assembly 52 during a cutting operation. The table guide 76 may comprise a plurality of vertical guide pins attached to the front edge of the horizontal table 30. The guide pins slidably engage the engage openings in the assembly base 22. In an alternate embodiment, the plurality of vertical guide pins are attached to the upper surface of the assembly base 22 and slidably engage openings (not shown) in the horizontal table 30.

The upper surface of the brick support table 30 may be provided with ruled markings, which allow the operator to position a brick or tile to be cut to a desired length. The markings may be a set of evenly spaced lines parallel to the chisel cutting edges. Markings at commonly used angles, such as 30°, 45°, or 60° may also be provided.

A lever attachment assembly 82 is provided to connect the lever operating assembly to the upper blade assembly. Lever attachment assembly 82 may comprise a pair of level attachment members, each lever attachment member being pivotally attached to the end of the uppermost track rider on the corresponding side.

Two openings 88 and 90 are provided in each lever attachment member for attaching the lever attachment assembly to the lever operating assembly. An uppermost opening is 88 used to provide a minimum initial spacing between the upper and lower chisel edges when the operating lever is in the at rest position, while the lower most opening 90 provides a larger initial spacing. Using either the lower openings or the upper openings, each lever attachment member is removably and pivotally attached to the corresponding member of the final lever 38.

Using the minimum initial spacing while cutting thin masonry pieces, such as tile, reduces the motion required to complete the cut, thus making the operation more efficient. At the larger initial spacing, the apparatus 20 can accommodate a variety of sizes of larger bricks 32.

In an alternate embodiment, the spacing between the upper and lower chisels can be reduced by placing a spacing element between the assembly base 22 and the lower chisel base 50.

The position of the levers, the lever support system 36, and the track assemblies 40 is such that, as the upper chisel 40 is moved through its full range of motion, the force application angle (the angle formed by the lever attachment member and the final lever member) is kept within a small range around 90°. Because the force application angle varies only within a controlled range, materials of widely varying sizes can be cut without the necessity of adjusting the cutting positions of the upper 40 or lower 52 chisel. Nearly the full designed mechanical advantage, and thus the full cutting force, is available over the entire range of motion of the lever operating mechanism. For example if the force application angle is constrained to stay within 20° above or below 9°, 93% or greater of the developed force can be applied at the chisel edges over the full range of travel of the lever operating assembly and the upper chisel.

A spring may be provided for returning the lever operating assembly to the starting position after a cutting operation. One end of the spring is attached to the assembly base 22, while the opposite end of the spring is attached to a movable portion of the lever operating assembly 46. In operation, the spring is placed in placed in tension or compression by the motion of the handle 92 during a cutting operation. When the handle 92 is released by the operator 94, the stored energy of the spring returns the operating lever mechanism to the starting position so that the apparatus is ready perform a subsequent cutting operation.

A latch (not shown) may be provided to hold the apparatus in a compact arrangement for storing or transportation. An upper portion of the latch attaches to the operating handle 92 of the lever mechanism 84, while the lower portion of the latch is attached to the assembly base 22. Preferably the latch is releasably attached to the operating lever. In the latched position, the operating lever is secured in its lowermost position, resulting in a compact arrangement facilitating moving or storing the apparatus.

A handle may be provided for transporting the apparatus to the desired location. In an exemplary embodiment the handle consists of a frame welded to the rear end of the base the frame comprises side members 34 welded to either side with a cross member 86 welded between the two side members 34. The side members 34 provide convenient purchase for two persons to carry the brick cutter 20, while the cross member 86 is convenient for carrying the apparatus 20 by a single person.

A process to cut masonry material, such as bricks or tile, using the invention comprises placing a masonry piece 32 on the brick support table 30 and aligning the piece 32 between the upper 40 and lower 52 chisels so that the upper and lower chisel edges are aligned with the location of the intended cut of the masonry piece 32; applying a downward force on the manual operating lever 24 so that the upper chisel 40 contacts the piece, applying a downward force that lowers the brick support table 30, allowing the lower chisel 52 to contact the lower surface of the masonry piece; applying further downward force to the manual operating lever 84 to apply force to the masonry piece through the upper 40 and lower chisel 52, thereby cutting the masonry piece 32.

It is to be understood that the present invention is not limited to the embodiments described above, but encompasses any and all embodiments within the scope of the following claims.

I claim:

1. An apparatus for cutting masonry materials, comprising:

an assembly base;

a plurality of resilient mounts attached to the assembly base;

a table mounted on the resilient mounts, the table having a slot defined therein, the table being adapted for supporting masonry material to be cut;

a lever support extending from the assembly base;

a lever pivotally mounted to the lever support;

said lever comprising a first and second lever member and a plurality of cross members attached between the first lever member and the second lever member, the first lever member and the second lever member being pivotally attached to the lever support;

an upper chisel pivotally mounted on the lever, the upper chisel being positioned above the table and aligned with the slot; and a lower chisel extendable through the slot, whereby the masonry material is cut by coaction of the upper and lower chisels upon action of the lever.

2. The apparatus of claim 1, wherein the resilient mounts comprise springs.

3. The apparatus of claim 1, wherein the resilient mounts comprise compressible standoffs.

4. A method for cutting a piece of masonry material using the apparatus of claim 1, the method comprising:

placing the piece of masonry on an upper surface of the table above the slot in the table; and applying a downward motion to the lever to move the upper chisel downward to contact the surface of the piece of masonry.

5. The apparatus of claim 4, wherein said lever comprises a compound lever.

6. An apparatus for cutting masonry materials, comprising:

an assembly base;

a plurality of resilient mounts attached to the assembly base;

a table mounted on the resilient mounts, the table having a slot defined therein, the table being adapted for supporting masonry material to be cut;

a lever support extending from the assembly base;

a lever pivotally mounted to the lever support;

an upper chisel pivotally mounted on the lever, the upper chisel being positioned above the table and aligned with the slot;

a lower chisel extendable through the slot, whereby the masonry material is cut by coaction of the upper and lower chisels upon action of the lever; and an adjustable link, the lever being pivotally attached to the upper chisel by the adjustable link, whereby adjusting the adjustable link changes separation distance between the upper chisel and lower chisel.

7. An apparatus for cutting masonry materials, comprising:

an assembly base;

a plurality of resilient mounts attached to the assembly base;

a table mounted on the resilient mounts, the table having a slot defined therein, the table being adapted for supporting masonry material to be cut;

a lever support extending from the assembly base;

a lever pivotally mounted to the lever support;

a spring having one end attached to the base and an opposite end attached to the lever;

an upper chisel pivotally mounted on the lever, the upper chisel being positioned above the table and aligned with the slot; and a lower chisel extendable through the slot, whereby the masonry material is cut by coaction of the upper and lower chisels upon action of the lever.

* * * * *